US011879444B2

(12) United States Patent
Trebbi et al.

(10) Patent No.: US 11,879,444 B2
(45) Date of Patent: Jan. 23, 2024

(54) POSITIVE DISPLACEMENT PUMP

(71) Applicant: I.M.A. INDUSTRIA MACCHINE AUTOMATICHE S.P.A., Ozzano dell'Emilia (IT)

(72) Inventors: Claudio Trebbi, Medicina (IT); Luca Stefanini, Ozzano dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 677 days.

(21) Appl. No.: 16/971,302

(22) PCT Filed: Feb. 19, 2019

(86) PCT No.: PCT/IT2019/050033

§ 371 (c)(1),
(2) Date: Aug. 19, 2020

(87) PCT Pub. No.: WO2019/159213

PCT Pub. Date: Aug. 22, 2019

(65) Prior Publication Data

US 2020/0386215 A1 Dec. 10, 2020

(30) Foreign Application Priority Data

Feb. 19, 2018 (IT) ..... 102018000002800

(51) Int. Cl.
*F04B 53/16* (2006.01)
*F04B 13/00* (2006.01)

(52) U.S. Cl.
CPC ..... *F04B 13/00* (2013.01); *F04B 53/162* (2013.01)

(58) Field of Classification Search
CPC ..... F04B 53/162; F04B 9/02; F04B 17/03; F04B 13/00
See application file for complete search history.

(56) References Cited

U.S. PATENT DOCUMENTS 3,390,815 A 7/1968 Zdenek et al.
5,863,187 A * 1/1999 Bensley ..... F04B 7/06 417/500
2007/0196223 A1* 8/2007 Hogan ..... F04B 7/06 417/500

FOREIGN PATENT DOCUMENTS

CA 2423349 C * 11/2007 ..... G01F 11/021
EP 2902002 A1 8/2015
EP 3 023 638 A1 5/2016

OTHER PUBLICATIONS

International Search Report and Written Opinion for PCT/IT2019/050033, dated Apr. 17, 2019.

* cited by examiner

*Primary Examiner* — Abiy Teka
(74) *Attorney, Agent, or Firm* — MARSHALL, GERSTEIN & BORUN LLP

(57) ABSTRACT

A positive displacement pump, including at least a cylinder, provided with at least an entrance aperture and at least an exit aperture for the liquid and a plunger, mobile inside the cylinder by means of a first actuator and configured to transfer the liquid from the entrance aperture to the exit aperture; the cylinder is provided with at least a first inactive position and at least a second working position between which it can be selectively positioned in an automatic and adjustable manner by at least one second actuator.

10 Claims, 2 Drawing Sheets

POSITIVE DISPLACEMENT PUMP

FIELD OF THE INVENTION

The present invention concerns a positive displacement pump, in particular a positive displacement pump used for example in the pharmaceutical, food, cosmetic or similar field for metering liquids inside containers, bottles or suchlike.

BACKGROUND OF THE INVENTION

Positive displacement pumps are known, which can be used in particular in the above fields, which comprise at least one actuator associated, by means of a spherical, cardan or similar joint, with the plunger of a cylinder inside which a liquid or a mixture of liquids pass, from a suction area to a delivery area, wherein containers can be provided in which the liquid must be introduced with an appropriate and precise dosage.

The positive displacement pumps in question can therefore typically be associated with a liquid metering machine.

The cylinder of these positive displacement pumps can be oriented with respect to the actuator from a first inactive position, in which it is substantially aligned with the actuator, to a second working position, in which it is inclined by a certain angle with respect to the inactive position. An example of this type of positive displacement pumps is described in U.S. Pat. No. 5,863,187.

The plunger, in general, is subjected to an alternate motion along the cylinder and to a rotational motion with respect to its longitudinal axis, so as to transfer a certain quantity of liquid from an entrance aperture to a delivery aperture made in the cylinder.

In the body of the plunger a compartment is then made which is located alternately in communication with the entrance aperture and the delivery aperture so as to allow the removal and transfer of the liquid from the entrance aperture to the delivery aperture.

In these types of pumps, in general, the greater the inclination of the cylinder with respect to the actuator, the greater the stroke of the plunger inside the cylinder, and therefore the greater the volume of the part of the chamber comprised between the crown of the plunger and the top of the cylinder.

The working position of the cylinder can be established and disposed based on graduated scale normally located at the base of the pump, which indicates both the inactive, or resting, position, and also the working position at increasing angles, thus substantially with greater transfer of liquid.

Therefore, based on the desired working conditions, the cylinder will be more or less inclined with respect to the actuator.

Other examples of positive displacement pumps known in the state of the art are described in patent documents n. EP-A1-2.902.002 and EP-A1-3.023.638.

A first problem of these known positive displacement pumps is that the cylinder is usually moved manually, bringing a suitable indicator associated with the cylinder in correspondence with the desired angle and indicated on the graduated scale.

As can easily be understood, this manual drive can therefore be approximate and not very reliable, particularly for applications where the positive displacement pumps referred to in the present description are used, therefore applications where an appropriate precision and reliability of dosage are required.

It is evident that the manual drive of the cylinder is particularly unwelcome and disadvantageous in the above fields, where the liquid or the mixture of liquids must be treated in an environment and in ways that satisfy rather stringent hygiene and cleaning criteria. Consequently, the fact that the operator has to modify the inclination of the cylinder manually with respect to the actuator every time the adjustment of the positive displacement pump is necessary can compromise the hygiene and cleanness of the metering machine and of the metering process.

Another problem of known positive displacement pumps, directly connected to the fact that the cylinder is driven manually, is that these pumps do not provide a position in which they can be automatically washed, that is, washing that substantially does not require the operator coming into manual contact with the various parts of the pump.

Traditional pumps, in fact, are provided, as we said, with an inactive position, in which the cylinder is substantially aligned with the actuator, and a working position, in which the cylinder can be disposed with a certain inclination with respect to the actuator, but they do not provide a position in which an appropriate and automatic washing can be carried out.

It is evident that this is particularly disadvantageous due to the fact that the components of the positive displacement pump must be washed frequently to prevent the accumulation of dirt or external agents which can compromise the hygiene and the cleaning of the metering machine and the metering process.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

There is therefore a need to perfect a positive displacement pump that can overcome at least one of the disadvantages of the state of the art.

One purpose of the present invention is therefore to produce a positive displacement pump wherein the angular position of the cylinder with respect to the actuator of the plunger can be regulated in a precise and automated manner.

Another purpose of the present invention is to produce a positive displacement pump that is substantially self-cleaning, wherein the cylinder can be predisposed, as well as in an inactive or resting position and in a working position, also in a washing position, different from the working position, and wherein it is possible to perform an effective washing of the pump and draining of the liquid, or fluid, used for washing.

Another purpose of the present invention is therefore to produce a positive displacement pump that is overall better performing, more precise and reliable, both in the working steps as well as in the washing steps, than known positive displacement pumps.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes and according to a first aspect of the invention, a positive displacement pump comprises at least a cylinder, provided with at least an entrance aperture and at least an exit aperture for the liquid and a plunger, mobile inside the cylinder and configured to transfer the liquid from the entrance aperture to the exit aperture; the cylinder and the plunger extend along a longitudinal axis of development. The positive displacement pump according to the invention comprises a first actuator which is configured to drive the plunger in movement in an alternate rotational-translational motion along, and around, the longitudinal axis, and a second actuator configured to selectively move the cylinder, in an automatic and adjustable manner, at least between a first inactive position and a second working position. In the first inactive position the cylinder is aligned with the first actuator along a reference axis, while in the second working position the longitudinal axis of development of the cylinder is inclined with respect to the reference axis.

Thanks to the presence of at least two distinct actuators, therefore, one to regulate the position of the cylinder and one to drive the plunger, the present positive displacement pump can be advantageously and effectively used, in particular, in applications where a high level of precision, reliability and rapidity in the metering of a liquid inside containers, bottles or suchlike, is required, without needing to use manual and at times approximate operations, above all with regard to regulating the position of the cylinder.

In positive displacement pumps according to the invention, the second actuator is also configured to take the cylinder at least to a third washing position, different from the first inactive position and from the second working position, and in which the cylinder is further inclined with respect to the second working position.

To this end, the cylinder can comprise a second exit aperture for the liquid in the third washing position.

The third washing position can be defined by at least a washing angle of the cylinder and the second working position can be defined by at least a working angle of the cylinder different from the washing angle. The washing and working angles are the angles that extend between the longitudinal axis of development and the reference axis, respectively when the cylinder is in the third washing position and in the second working position.

The washing angle of the cylinder is preferably greater than the working angle of the cylinder.

The working angle of the cylinder is preferably comprised between about 0° and about 15°, where the first inactive position of the cylinder, in which the longitudinal axis of development coincides with the reference axis, is defined at 0°.

The washing angle C is comprised between about 35° and about 45°.

In a preferred embodiment, the washing angle C is equal to about 40°.

The second actuator can for example comprise, as drive member, a worm screw able to cooperate with at least a motion transmission element associated with the cylinder.

The first actuator can be connected to the plunger by means of at least a joint member that allows the plunger to move according to a rotational-translational motion in the cylinder.

The first actuator and said second actuator can be associated with a control unit of the positive displacement pump.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
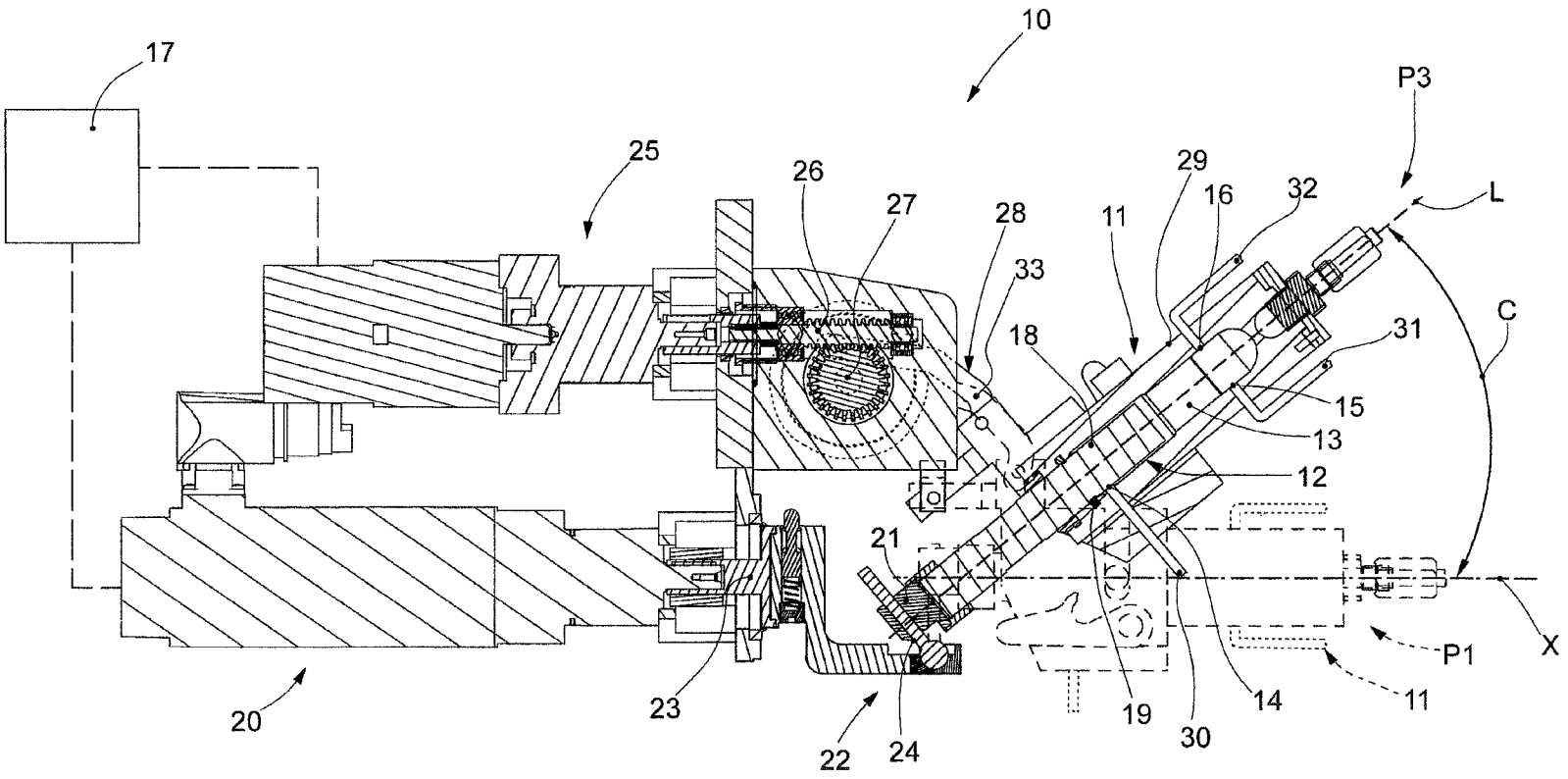
FIG. 1 is a section view of a positive displacement pump according to the invention in a washing position.
Figure 2:
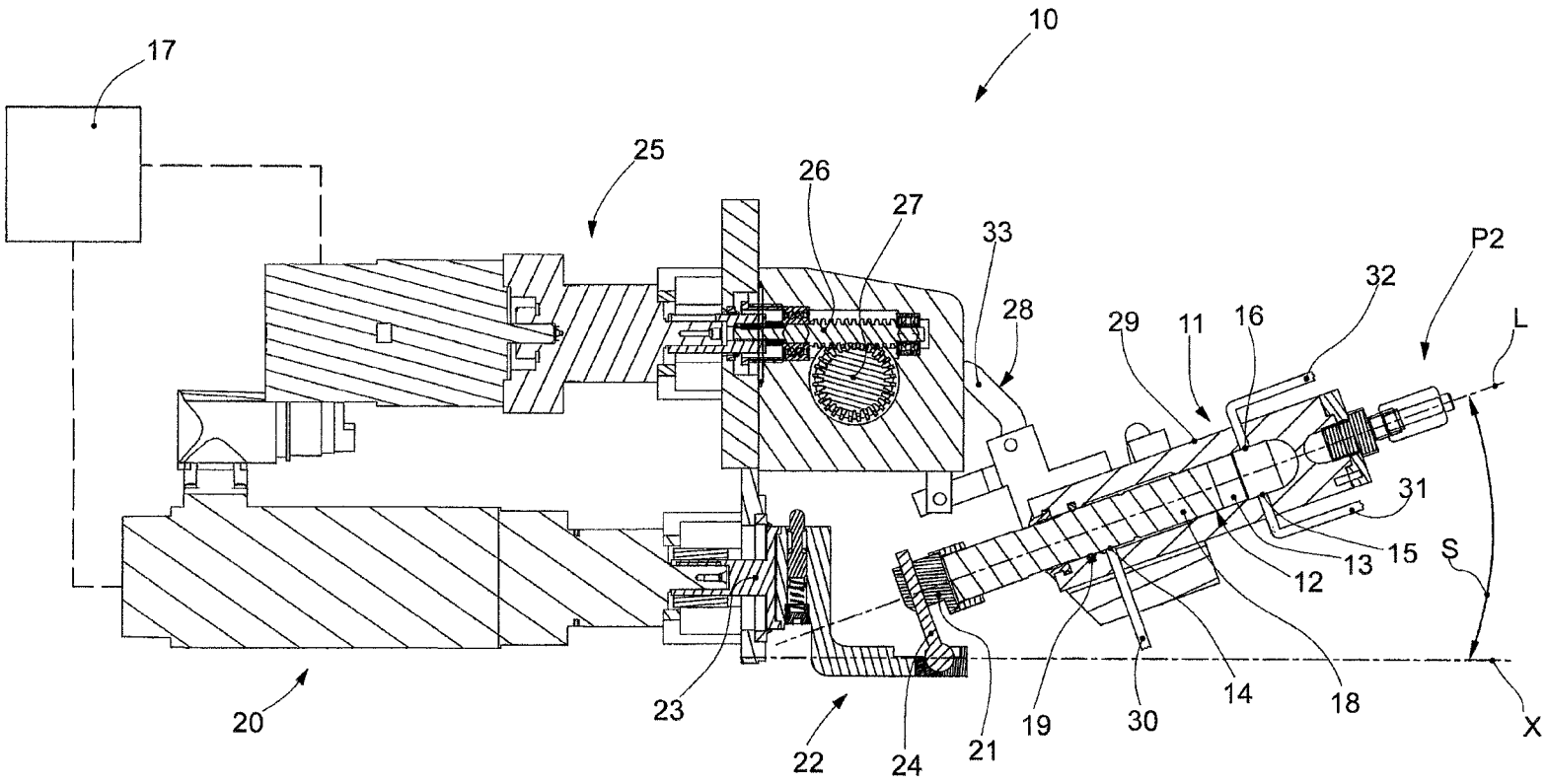
FIG. 2 is a section view of the positive displacement pump in a working position.

With reference to FIGS. 1 and 2 of the attached drawings, a positive displacement pump according to the present invention, for example a rotational positive displacement pump, comprises a cylinder 11 provided internally with a chamber 13 in which a plunger 12 is slidable.

The cylinder 11 and the plunger 12 extend along a longitudinal axis L.

The plunger 12 can be advantageously made with ceramic or composite materials.

The cylinder 11 comprises an external part or jacket 29 inside which the plunger 12 can slide.

The chamber 13 can be in fluidic connection with an entrance aperture 14 for the fluid inside the cylinder 11 and with at least a first exit aperture 15 for the fluid.

The first exit aperture 15 allows to transfer the fluid removed from the entrance aperture 14 toward a container or bottle in which it has to be poured in a metered manner, for example by means of a metering nozzle or suchlike.

A second exit aperture 16 is instead disposed in the chamber 13 to drain and discharge the washing liquid of the present positive displacement pump 10, in particular of the cylinder 11.

Therefore, a determinate liquid for the self-cleaning of the positive displacement pump 10, introduced through the entrance aperture 14, can be discharged into the chamber 14 through the second exit aperture 16.

The entrance and exit apertures 14, 15 and 16 can be associated, in a known manner, with corresponding pipes 30, 31, 32 to feed and transfer the liquid.

The pipes 30, 31, 32 can comprise flexible pipes, made for example of suitable polymeric materials, and are indicated schematically in the attached drawings.

In some embodiments, valves to intercept and regulate the flow of the liquid can be associated with the pipes 30, 31, 32 to regulate the flow of the liquid through them.

The plunger 12 comprises a body 18 in which a compartment can be made (not visible in the drawings) able, as previously described, to allow the passage of the liquid from the entrance aperture 14 to the exit aperture 15 following the rotation of the plunger 12 around the longitudinal axis of development L and its alternate translation along the same axis.

The fluid seal of the sliding and rotation of the plunger 12 inside the cylinder 11 can be guaranteed for example by means of at least a gasket 19, such as an O-ring or suchlike.

The positive displacement pump 10 comprises at least a first actuator 20 that is associated with the plunger 12 to drive it in movement according to said alternate rotational-translational motion along, and around, the longitudinal axis of development L.

The plunger 12 can comprise, for example in correspondence with the bottom, a closing element 21 that engages with a joint member 22 associated with a drive shaft 23 of the first actuator 20.

In particular, the closing element 21 can engage in a sliding manner with a rod 24 of the joint member 22.

The rod 24 is connected in a rotational manner to the joint member 22 so as to obtain a spherical joint that connects the plunger 12 with the first actuator 20.

Following the rotation of the drive shaft 23, the joint member 22 is conformed so as to allow both the rotation of the plunger 12 and also its alternate translation inside the cylinder 11.

The cylinder 11 can assume a first resting, or inactive, position P1, shown in broken lines in FIG. 1, and at least a second working position P2, shown in FIG. 2.

Moreover, the cylinder 11 can advantageously assume a third washing position P3, shown in a continuous line in FIG. 1.

The resting, or inactive, position P1 is substantially a position in which the cylinder 11 is aligned with the first actuator 20 along a reference axis X, as shown in FIG. 1. In this inactive position P1, the longitudinal axis of development L coincides with, and overlaps, the reference axis X.

The working position P2 is a position in which the cylinder 11 is inclined by a certain working angle S with respect to the inactive position P1.

The working angle S is defined as the angle defined between the longitudinal axis of development L and the reference axis X, when the cylinder 11 is in the working position P2.

The working angle S can be variable according to the different operating requirements of the positive displacement pump 10. The working angle S can be between about 0° and about 15°, where the inactive position P1 of the cylinder 11 is defined at 0°. In other words, when the working angle S is equal to 0°, the longitudinal axis of development L coincides with the reference axis X.

The washing position P3 is a position in which the cylinder 11 is further inclined with respect to the working position P2.

In particular, the washing angle C, that is, the angle of inclination of the cylinder 11 in the washing position P3, must be such as to guarantee an appropriate drainage of the liquid from the exit aperture 16.

The washing angle C is defined as the amplitude of the angle that extends between the longitudinal axis of development L and the reference axis X, when the cylinder 11 is in the washing position P3.

In possible implementations, the washing angle C is preferably bigger than the working angle S.

Moreover, the washing angle C is advantageously much bigger than the working angle S so that an operator can visually distinguish immediately if the positive displacement pump 10 is in the working step or in the washing step.

The washing angle C can be comprised, for example, between about 35° and 45°, so as to guarantee an effective washing and draining of the liquid.

In a preferred embodiment, the washing angle C is approximately equal to 40°.

As we said, the bigger the angle of inclination of the cylinder 11 to the reference axis X, that is, with respect to the first actuator 20, the bigger the volume of the chamber 13 defined between the crown of the plunger 12 and the end of the cylinder 11. For this purpose, the different volume of the chamber 13 in the washing position P3 and in the working position P2 is clearly visible in FIGS. 1 and 2.

Advantageously, the positive displacement pump 10 comprises a second actuator 25 that can automatically drive the cylinder 11 to move, in a precise and automatic manner, at least from the inactive position P1 to the working position P2, and vice versa.

The second actuator 25 can also be used to take the cylinder 11 from the inactive position P1, or from the working position P2, to the washing position P3, and vice versa.

In one embodiment, the second actuator 25 comprises a drive shaft, for example a worm screw 26, able to engage in a corresponding motion transmission element 27, for example a toothed wheel or suchlike.

In alternative embodiments, the second actuator 25 can comprise motion transmission means different from the worm screw 26 and the transmission element 27 described above, but totally equivalent thereto. For example, the motion transmission means can comprise two or more gears, an oscillating glyph, or other motion transmission members, of a type known in the state of the art.

The transmission element 27 can transfer the motion received from the worm screw 26 to the cylinder 11, in particular to its external part 29, by means of a connection mechanism 28 associated with the cylinder 11 and with the transmission element 27.

In one embodiment, the connection mechanism 28 comprises an arm 33 which on one side is attached to the external part 29 and, on the other side is attached to the transmission element 27 so that the arm 33 moves together with the transmission element 27, thus modifying the inclination of the cylinder 11 as a function of the rotation of the transmission element 27.

The positive displacement pump 10 comprises a control unit 17 connected both to the second actuator 25 to regulate the inclination of the cylinder 11, and to the first actuator 20 which drives the plunger 12. The positive displacement pump 10 is configured to control the functioning of the actuators 20, 25 in a reciprocally coordinated manner to actuate the instructions of a user.

The control unit 17 is configured to regulate the quantity of liquid to be metered by adjusting the width of the working angle S of the cylinder 11, so that it is in a working position P2 that allows the positive displacement pump 10 to send the desired quantity of liquid to be metered.

Furthermore, the control unit 17 allows to take the cylinder 11 also into the washing position P3 when it is necessary to wash the positive displacement pump 10.

The present positive displacement pump 10 can therefore assume, in an automatic manner and without substantially requiring the intervention of operators, a plurality of different positions, that is, positions in which the cylinder 11 is in an inactive condition or a working condition, with an inclination defined by the working angle S. This positioning of the cylinder 11 in a working position P2 or in an inactive position P1 is guaranteed in a precise and automatic manner thanks to the second actuator 25.

The second actuator 25 also allows, advantageously, to take the cylinder 11 into a self-cleaning condition, where it assumes an inclination defined by the washing angle C, or into a further washing position P3.

In the washing position P3, as we said, a suitable washing liquid can be sent to the cylinder 11 by means of the entrance aperture 14 and can be drained, when the washing is completed, by means of the exit aperture 16. The parameters relating to the washing functions, such as for example the quantity of washing liquid, duration of the wash, possibility of automatically predisposing one or more washing cycles and others, can be set and managed by means of the control unit 17.

Thanks to the presence of at least two distinct actuators 20 and 25, therefore, one to regulate the inclination of the cylinder 11 and one to regulate the drive of the plunger 12, the present positive displacement pump 10 can be advantageously and effectively used, in particular, in applications that require great precision, reliability and speed in metering a liquid inside containers, bottles or suchlike.

Moreover, it is understandable that an automated and possibly programmable washing for the present positive displacement pump 10, thanks also to the use of the second actuator 25, guarantees considerably improved operating conditions compared with known positive displacement pumps, both from a functional point of view and from a hygiene point of view.

It is clear that modifications and/or additions of parts may be made to the positive displacement pump as described heretofore, without departing from the field and scope of the present invention.

It is also clear that, although the present invention has been described with reference to some specific examples, a person of skill in the art shall certainly be able to achieve many other equivalent forms of positive displacement pump, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A positive displacement pump configured to deliver desired quantities of liquid and comprising at least a cylinder, provided with at least an entrance aperture and at least an exit aperture for the liquid, and a plunger, mobile inside said cylinder and configured to transfer the liquid from said entrance aperture to said exit aperture, wherein said cylinder and said plunger extend along a longitudinal axis of development; said positive displacement pump also comprises a first actuator configured to drive said plunger in movement in an alternate rotational-translational motion along and around said longitudinal axis of development, and is comprising a second actuator configured to selectively move said cylinder, in an automatic and adjustable manner, at least between a first inactive position in which said cylinder is aligned with said first actuator along a reference axis, and a second working position in which said longitudinal axis of development of said cylinder is inclined with respect to said reference axis.

2. The positive displacement pump as in claim 1, wherein said second actuator is also configured to take said cylinder at least to a third washing position, different from said first inactive position and from said second working position, and in which said cylinder is further inclined with respect to said working position.

3. The positive displacement pump as in claim 2, wherein said cylinder comprises a second exit aperture for the liquid which defines a draining aperture for the liquid used to wash said positive displacement pump internally when said cylinder is in said third washing position.

4. The positive displacement pump as in claim 2, wherein said third washing position is defined by at least a washing angle of the cylinder which is the angle that extends between said longitudinal axis of development and said reference axis, when said cylinder is in said third washing position, and said second working position is defined by at least a working angle of the cylinder which is the angle that extends between said longitudinal axis of development and said reference axis, when said cylinder is in said second working position; said working angle being different from said washing angle.

5. The positive displacement pump as in claim 4, wherein said washing angle of the cylinder is bigger than the working angle of the cylinder.

6. The positive displacement pump as in claim 4, wherein said working angle of the cylinder is comprised between about 0° and about 15°, where the first inactive position of the cylinder, in which said longitudinal axis of development coincides with said reference axis, is defined at 0°.

7. The positive displacement pump as in claim 4, wherein said washing angle is comprised between about 35° and about 45°.

8. The positive displacement pump as in claim 1, wherein said second actuator comprises a worm screw able to cooperate with at least a motion transmission element associated with said cylinder.

9. The positive displacement pump as in claim 1, wherein said first actuator is connected to the plunger by means of at least a joint member that allows said plunger to move according to a rotational-translational motion in said cylinder.

10. The positive displacement pump as in claim 1, comprising a control unit connected both to said second actuator and also to said first actuator, which is configured to command said actuators in a reciprocally coordinated manner.

* * * * *